US005657893A

United States Patent [19]

Hitchings

[11] Patent Number: 5,657,893

[45] Date of Patent: Aug. 19, 1997

[54] SECURITY CONTAINER WITH RELEASABLY LOCKING RECEPTACLE AND LID

[75] Inventor: Glenn Edward Hitchings, Marrickville, Australia

[73] Assignee: Plastech Industries Pty Limited, Marrickville, Australia

[21] Appl. No.: 221,690

[22] Filed: Mar. 31, 1994

[30] Foreign Application Priority Data

Aug. 23, 1993 [AU] Australia ..... PM0811

[51] Int. Cl.[6] ..... B65D 45/16

[52] U.S. Cl. ..... 220/326; 220/284; 220/324; 220/338; 70/58; 70/345; 292/20; 292/80

[58] Field of Search ..... 292/19, 20, 80; 70/58, 62, 345; 220/326, 324, 284, 306, 307, 338, 780, 784, 787

[56] References Cited

U.S. PATENT DOCUMENTS

| | | | |
|---|---|---|---|
| 1,080,859 | 12/1913 | Stamm | 220/326 X |
| 1,975,173 | 10/1934 | Pennock et al. | 220/326 X |
| 2,535,275 | 12/1950 | Dixon | 220/326 X |
| 3,780,468 | 12/1973 | Maffett | 220/324 X |
| 3,841,518 | 10/1974 | Hines | 220/326 X |
| 3,891,070 | 6/1975 | Montanari | 220/4.23 X |
| 4,212,415 | 7/1980 | Neely | 220/324 X |
| 4,673,100 | 6/1987 | Reis et al. | 220/284 X |
| 4,746,008 | 5/1988 | Heverly et al. | 220/338 X |
| 4,840,286 | 6/1989 | Heberling et al. | 220/307 X |
| 5,311,643 | 5/1994 | Marquardt et al. | 220/338 X |

FOREIGN PATENT DOCUMENTS 9112612 8/1991 WIPO .

*Primary Examiner*—Allan N. Shoap
*Assistant Examiner*—Robin A. Hylton
*Attorney, Agent, or Firm*—Abelman, Frayne & Schwab

[57] ABSTRACT

A container includes a receptacle portion and a lid, butt ends thereof being hingeably connected one to the other; one or more resiliently mounted teeth are formed which extend upwardly from a forward end of the receptacle portion, and which include a body portion with a recess extending therethrough; a plurality of laterally spaced apart protrusions are provided and extend inwardly from a forward end of the lid, such that on the lid being hinged over the receptacle portion, the protrusions contact and move over the resiliently mounted teeth, so as to releasably engage within the recesses and so as to releasably lock the receptacle portion and lid together. Recesses are provided and extend through an upper surface of the lid, adjacent a front face thereof, so as to allow for the insertion of a release mechanism therethrough and between said one or more teeth and a forward end of said lid, so as to allow for disengagement between said one or more teeth and said one or more protrusions and subsequent release of said lid from said receptacle portion.

11 Claims, 6 Drawing Sheets

SECURITY CONTAINER WITH RELEASABLY LOCKING RECEPTACLE AND LID

BACKGROUND OF THE PRESENT INVENTION

Figure 1A:
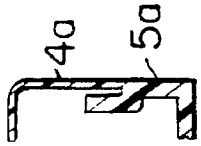

This invention relates to an improved container and in particular to a container for use, in one form of the invention, as a security container.

In this day and age containers are used for a number of purposes and in particular are used in connection with the sale and, renting of video tapes, compact discs, computer games and the like. Such products are often placed in security containers for display, wherein the security containers carry some form of coding or bar code, so that if the containers are removed from a premises without authority, monitoring means will actuate appropriate alarms. For example, in premises where videos, tapes, compact discs, video games and the like are rented out, the games are placed in containers, such as clear plastic containers, and are placed on shelves. These are then viewed by customers and a choice made. Normally the containers are security coded or have some bar code associated therewith for security purposes.

Once a choice is made, the container enclosing the chosen video, disc, video game or the like is taken to the counter and the appropriate money paid. An attendant or assistant at the counter will then remove the video, tape, video game or the like from the container, thereafter handing the chosen article to the purchaser, so that the purchaser can leave the store. Clearly, if the purchaser attempts to leave the store with the video, tape, disc or video game retained in the container, alarms and the like will be actuated.

Reference to the renting of video tapes, discs, video games and the like is by way of example only it should be appreciated that containers can be used in many areas, such as for the display of any desired goods for rental, sale or the like. They can be used in department stores, retail stores, wholesale outlets or the like.

It will however be appreciated that it is important that containers which display such goods are in essence security containers which cannot be easily opened so that the goods displayed therein or contained therein can be removed. Various forms of security container have been suggested and are known. However, these are often difficult and time consuming to manufacture and effectively to use.

It is an object of one aspect of this invention to go at least some way towards overcoming or at least minimizing problems associated with such security containers up until this time.

It is a further object of one aspect of this invention to provide a straightforward and efficient security container.

It is a further object of one aspect of the present invention to provide a straightforward and efficient releasable locking means for use in association with a container, which may, in one form of the invention, be a security container.

SUMMARY OF THE PRESENT INVENTION

According to one aspect of this invention, there is provided a container including a receptacle portion and a lid; and wherein butt ends thereof are hingeably connected one to the other; front faces of said receptacle portion and said lid being so formed as to allow for releasable locking engagement therebetween; one or more resiliently mounted teeth being formed or provided at and within, a front face of said receptacle portion; said one or more teeth including a body portion with a recess extending therethrough; one or more protrusions being provided and extending inwardly from a front face of said lid; wherein on said lid being hinged downwardly over said receptacle portion, said one or more protrusions will contact and move over said one or more resiliently mounted teeth, so as to releasably engage within said recess(es) of said one or more teeth and so as to releasably lock said receptacle portion and said lid together; one or more access means being provided and extending through a top of said lid, adjacent a front face thereof, such as to allow for the insertion of release means through said one or more access means and between said one or more teeth and a front face of said lid, such as to bring about disengagement between said one or more teeth and said one or more protrusions, and subsequent release of said lid from said receptacle portion.

According to a further aspect of this invention, there is provided a security container including a receptacle portion and a lid, and wherein butt ends thereof are hingeably connected one to the other; front faces of said receptacle portion and said lid being so formed as to allow for releasable locking engagement therebetween; a plurality of resiliently mounted, laterally spaced apart, teeth being formed with and extending upwardly from, a front face of said receptacle portion; said teeth each including a body portion with a recess extending therethrough, and a plurality of laterally spaced apart protrusions extending inwardly from a front face of said lid, wherein, on said lid being hinged downwardly over said receptacle portion, said protrusions will contact and move over said resiliently mounted teeth, so as to releasably engage within the said recesses and so as to releasably lock said receptacle portion and said lid together; one or more access means being provided in and extending through a top of said lid, adjacent a front face thereof, such as to allow for the insertion of release means through said one or more access means and between each resilient tooth and a front face of said lid, such as to bring about disengagement between said teeth and said protrusions, and subsequent release of said lid from said receptacle portion.

According to a further aspect of this invention, there is provided a security container including a receptacle portion and a lid; butt ends of said receptacle portion and said lid being hingeably connected one to the other; wherein adjacent butt ends thereof are provided with alternately, laterally spaced apart cylindrical portions having an elongate opening in a wall thereof and curvilinear cover portions; such that with said adjacent butt ends juxtaposed relative to each other, so as to be hingeably engageable, the spaced apart cylindrical portions of respective butt ends are so located relative to each other, that bores extending therethrough are in substantial axial alignment, such as to allow the insertion and location of elongate retaining means therein and therethrough; said alternately and laterally spaced apart cover portions extending at least partially over and about each of said cylindrical portions; front faces of said lid and said receptacle portion being provided with means to allow for a releasable locking engagement therebetween; wherein a front face of said receptacle portion is formed and provided with a plurality of resiliently mounted, laterally spaced apart, recessed teeth; a front face of said lid being provided with a plurality of inwardly extending and laterally spaced apart protrusions, such that when the front face of said receptacle portion and said lid are hingeably brought together, said protrusions will contact and move over, so as to releasably engage with, said resiliently mounted teeth; one or more access means being provided in and extending through a top of said lid, adjacent the location of said protrusions, to allow for the insertion of release means such as to engage between each resilient tooth and engaged protrusion, so as to bring about disengagement therebetween and the release of said locking engagement between said lid and receptacle portion.

Figure 1:
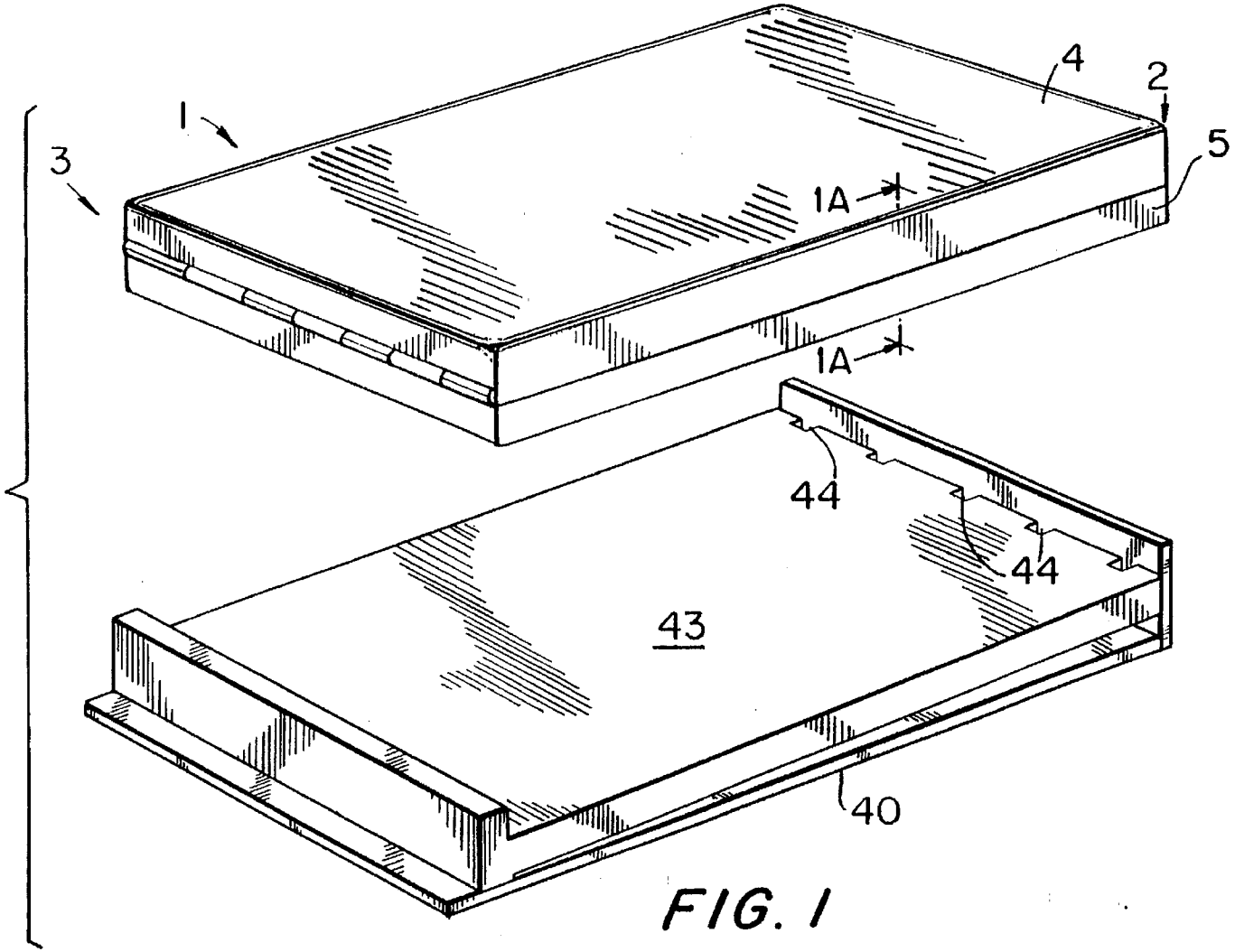
Figure 2:
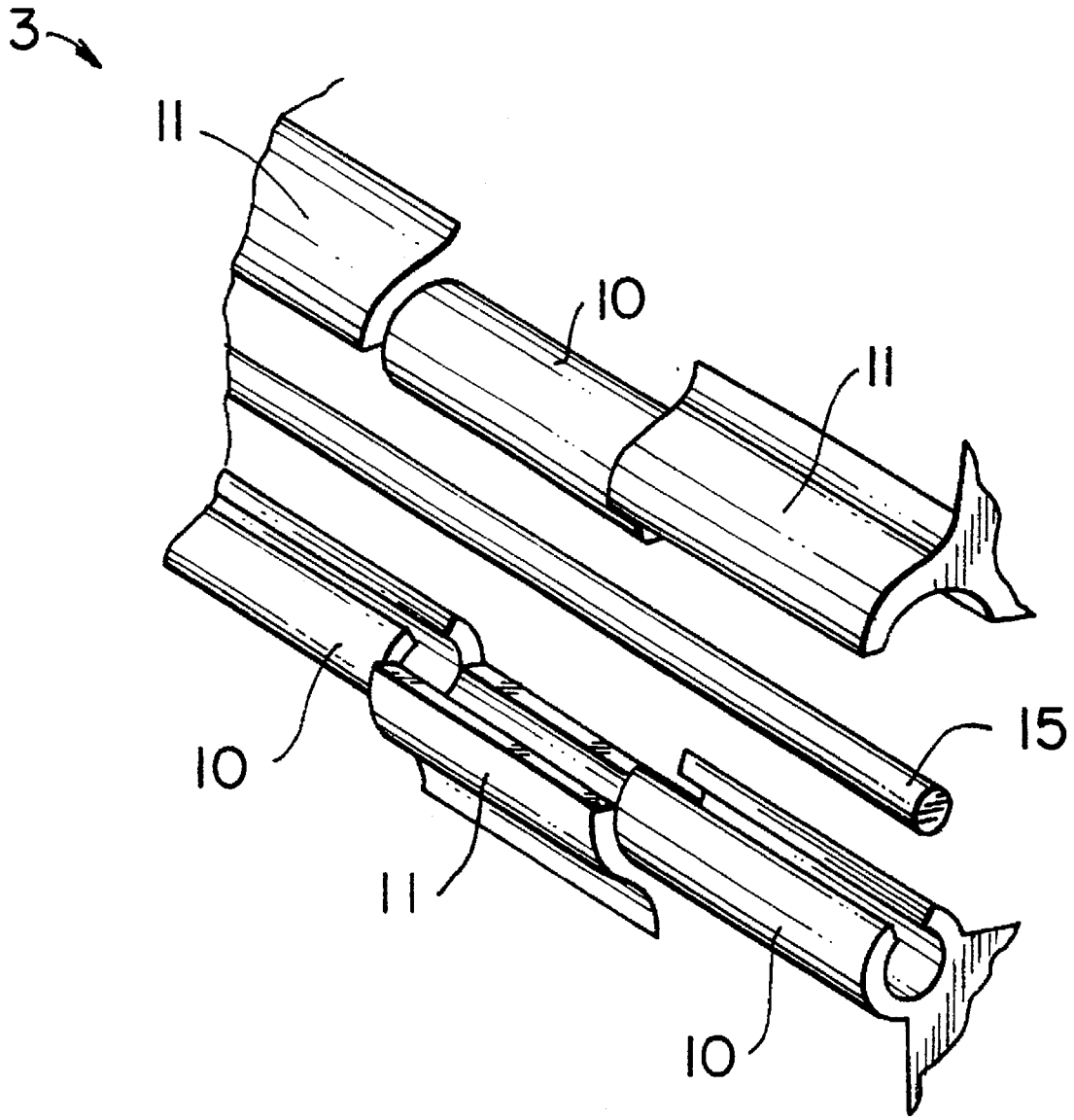
Figure 3:
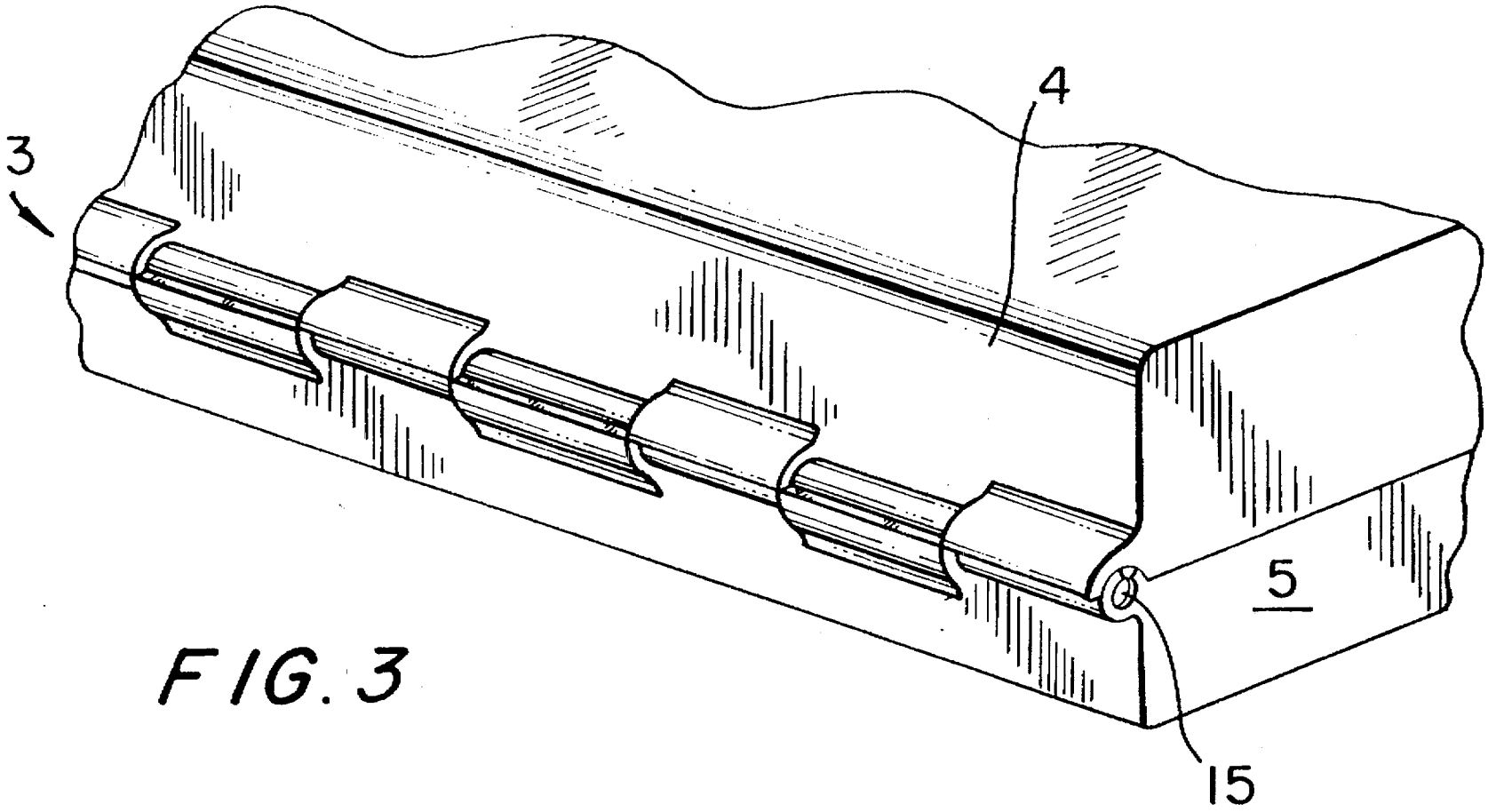
Figure 4A:
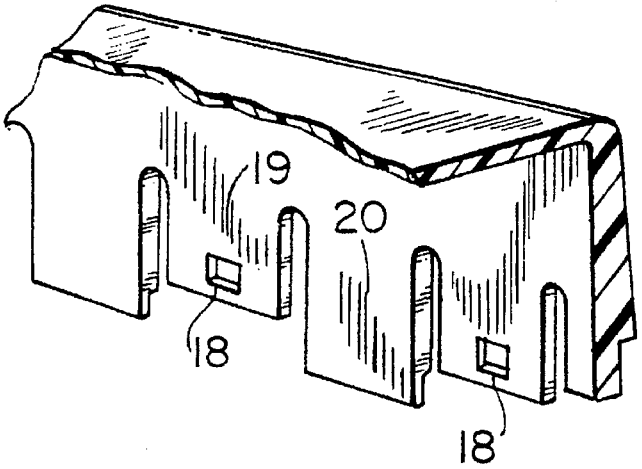
Figure 4B:
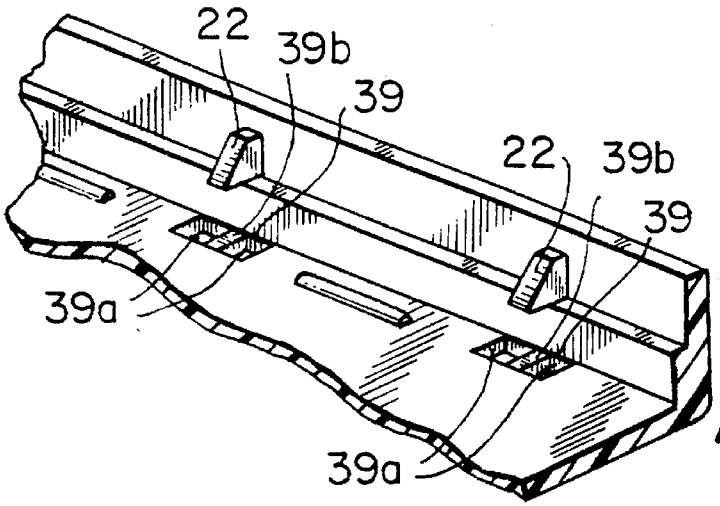
Figure 4C:
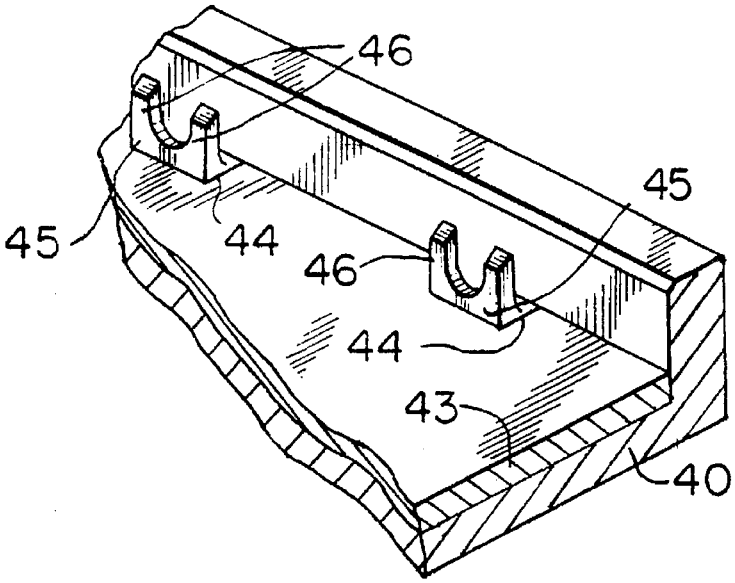
Figure 5:
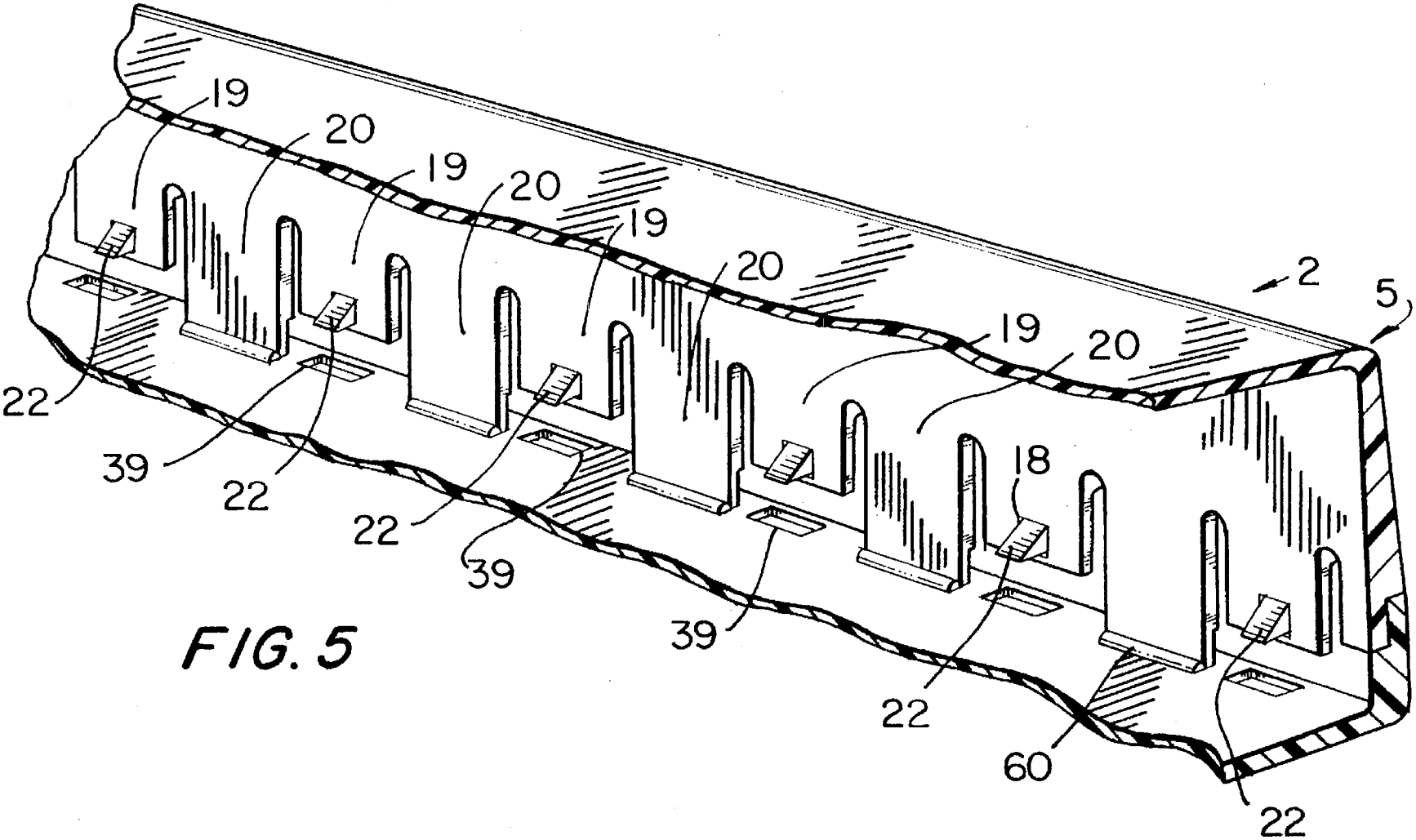
Figure 6:
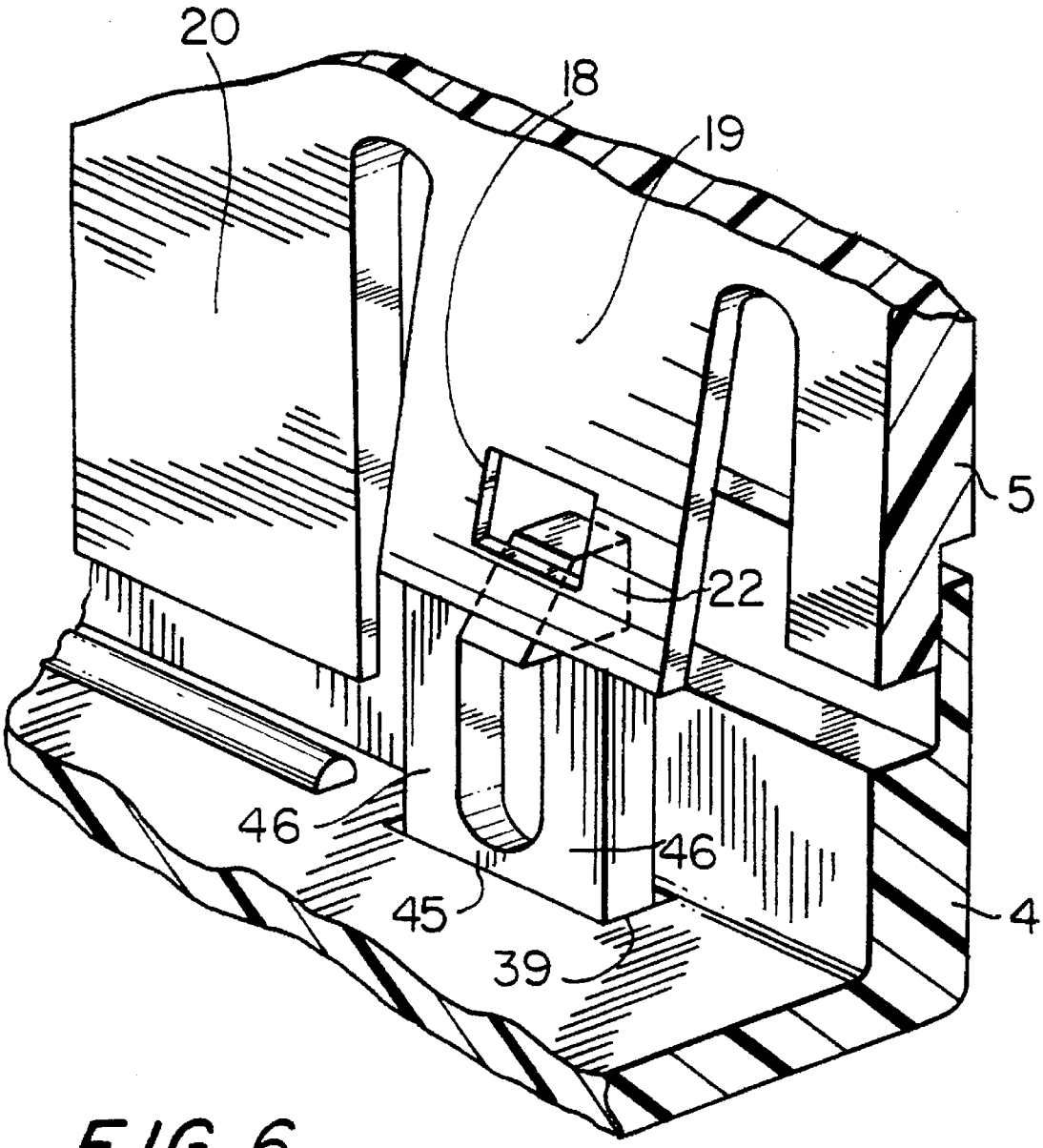

This invention will now be described by way of example only and with reference to the accompanying drawings wherein:

FIG. 1: is a generally exploded view of a security container and a release means, FIG. 2: is an exploded view of a hinge arrangement, FIG. 3: is a further view of a hinge arrangement (in engaged form), FIGS. 4*a*, 4*b* and 4C are exploded sectional views of front portions of a receptacle portion and lid (in a substantially inverted orientation), of a container, together with a release means according to one form of the invention, FIG. 5: is a partially sectional exploded view of the interengagement between front ends of a receptacle portion and lid (in a substantially inverted orientation), of a container according to one form of the present invention, and FIG. 6: is a partially exploded sectional view of an interengagement of front portions of a receptacle portion and lid (in a substantially inverted orientation), according to one form of the invention showing also release means in operation according to one form of the invention.

This invention will now be described by way of example only with reference to the accompanying drawings with particular reference to a security containers. It should be appreciated however that the invention has application in other areas and to all forms of containers. In particular, it should be appreciated that the present application describes a hinge arrangement and locking arrangement as being incorporated into a single container. It should be appreciated that the hinging arrangement has application to all forms of containers, and that the locking arrangement which allows for the releasable locking engagement between two components also has application in areas other than the area of is security containers. Also, it should be appreciated that the locking arrangement can be used with other forms of hinging arrangement.

It will however be appreciated that the invention has particular application to security containers, such as for use in the display and sale of goods, such as those mentioned above by way of example only.

In FIGS. 4, 5 and 6 of the drawings, the container 1 is shown in an inverted position or orientation, with the lid 4 lowermost, as it is in this position that in one form of the invention the container 1 is applied to release means for releasing locked or engaged receptacle portion 5 and lid 4.

In one form of the invention the container 1 is formed of a clear plastic material, although, again, this is by way of example. The container 1 can be constructed of any appropriate material. The container 1 preferably has a main body portion in the form of a receptacle portion 5, adapted to receive the product or products concerned, and a lid 4 hingeably connected thereto. Preferably, the receptacle portion 5 and lid 4 are hingeably engaged at butt ends 3 thereof, while at the front faces 2 of the container means are provided to allow for the releasable engagement between the receptacle portion 5 and lid 4. The hinge arrangement and releasable locking arrangement will be described further hereinafter with particular reference to all figures of the accompanying drawings.

Since, in one form of the invention, it is preferred that the container 1 be a security container, side edges 4*a* and 5*a* of the lid 4 and receptacle portion 5 are preferably formed so as to provide a secure a closure as possible. For example, it is desired to avoid as far as possible the ability of people to flex open the sides of the container such as by the insertion of tools, screw drivers and the like. To this end, and referring to the sectional portion of FIG. 1 of the accompanying drawings, the outer sides 5*a* of the receptacle portion 5 can be stepped so that on the lid 4 being hinged down over an open face of the receptacle portion 5, the sides 4*a* of the lid 4 will extend over the inwardly stepped and upwardly extending upper portions 5*a* of the receptacle portion 5 and should prevent as far as possible the insertion of tools and the like. This is shown, as indicated, in the exploded sectional portion of FIG. 1 of the drawings.

We refer now, and by way of example only, to the hinge arrangement between the butt ends 3 of the lid 4 and the receptacle portion 5. As indicated above, this is described by way of example only with reference to the container of the present invention. Other forms of hingeable attachment are able to be used to advantage. Further, it should be appreciated that the invention in so far as it relates to the hinge relationship, has equal application to a hingeable relationship between any first and second members.

In the preferred form of the invention a hinge arrangement, is shown with reference to FIGS. 1, 2 and 3 of the drawings, wherein the adjacent butt ends 3 of the receptacle portion 5 and lid 4 are provided with laterally spaced apart and alternate housings or cylindrical portions 10 and substantially curvilinear cover portions 11. The housings or cylindrical portions 10 each have a bore extending therethrough and also have an elongate opening in a wall thereof so that in essence they are, when viewed in cross section, of an almost closed "C" configuration. The hinge configuration extends laterally across the butt ends 3 of both the lid 4 and the receptacle portion 5 alternating between such cylindrical portions 10 and outwardly extending and substantially curvilinear cover portions 11. As will be appreciated from the accompanying drawings and in particular FIGS. 1, 2 and 3 thereof; when the butt ends 3 of the receptacle portion 5 and the lid 4 are brought together so as to be hingeably engaged (such as by the insertion of an elongate connecting member or pin 15), the outwardly extending and substantially curvilinear cover portions 11 will extend over the partially open or slotted housings or cylindrical portions 10 so as to provide for an effective and straightforward hingeable relationship between first and second members and in the preferred form of the invention between the butt ends 3 of the receptacle portion 5 and the lid or cover portion 4.

If desired, open side ends of the outermost cylindrical portions 10 can be closed such as by moulding or the like, so as to prevent any chance of the connecting means or pins being dislodged or removed.

We turn now to the releasable locking arrangement provided in association with the present invention which allows for a releasable locking engagement between the receptacle portion 5 and a lid or top cover 4.

In the form of the invention shown with reference to the accompanying drawings, the front faces 2 of the receptacle portion 5 and lid or cover 4 are formed with means to enable or facilitate a releasable locking engagement therebetween. Means are also provided to allow for the insertion of specifically designed release means which will enable the locking arrangement to be released. The releasable locking engagement is however located securely within the confines of the closed container and is normally unable to be interfered with from outside. Further, in preferred forms of the invention the front surfaces and sides of the container 1 (such as surrounding the engagement means) are matt finished or formed of a "cloudy" plastic material so as to be substantially opaque, and so that the locking engagement within the container 1 cannot be viewed from outside. This is however by way of example only.

In a preferred form of the invention the front face 2 of the receptacle portion 5 is formed with one or more teeth 19. Preferably there are provided, a plurality of laterally spaced apart engagement means in the form of spaced apart and upwardly extending, resiliently mounted teeth 19 formed of an appropriate resilient plastic material. These teeth 19 are provided with recesses 18 extending therethrough. Preferably, and as shown in the accompanying drawings (and as will be described later), the resiliently mounted teeth 19 are spaced inwardly of the inner surface of the front face 2 of the lid portion 4, so as to provide a spacing therebetween.

Between each of the resiliently mounted and upwardly extending teeth 19, an upwardly extending abutment member 20 is provided being integrally formed with the inner surface of the front face 2 of the receptacle portion 5. The resiliently mounted teeth 19 and abutment portions 20 are laterally spaced apart one from the other, alternately, across the inner surface of the front face 2 of the receptacle portion 5. Upper or outer ends of the abutment portions or members 20 can preferably be stepped to engage with and behind lateral raised portions or engagement humps 60, which are stepped outwardly from the inner side of the lid or cover portion 4 (FIG. 5 of the drawings).

The front face 2 of the lid portion 4 is provided with a plurality of laterally spaced apart and inwardly extending locking protrusions 22, provided with an angled leading face, which are so dimensioned, positioned and profiled that when the lid 4 is brought down over the receptacle portion 5, the protrusions or lugs 22 will ride over and deflect the resiliently mounted teeth 19, so that the protrusions or lugs 22 thereafter engage within a recess 18 in the teeth 19, the teeth 19 then resiliently returning to their position of rest wherein the protrusions 22 and resiliently mounted teeth 19 engage in a locking engagement. The abutment members 20 extend upwardly beyond the resiliently mounted teeth 19 and between each set of teeth 19 to engage within an area between the inner front face 2 of the lid or cover portion 4 and the laterally extending and spaced apart lateral engagement humps 60 on the inner side of the lid or cover portion 4.

Further, and in the preferred form of the invention, one or more access means 39 are provided or formed through the top of the lid portion 4, adjacent the front face 2 thereof and above and adjacent to the location of the inwardly extending protrusions or lugs 22 (and when the lid portion 4 and receptacle portion 5 are engaged).

In the preferred form of the invention, the one or more access means 39 allow for the insertion of appropriate release means or tools to enable the simultaneous release of the protrusions 22 from the teeth 19. Various appropriate release means can be provided such as a tool having a plurality of inwardly extending lugs which are inserted substantially simultaneously into the one or more access means so as to pass down between the inner surface of the front face 2 of the lid portion 4 and the adjacent face of the spaced apart resilient teeth 19 to thereby deflect the resiliently mounted teeth 19 away from the front face 2 and the engaged protrusions 22, so as to essentially disengage the protrusions 22 and resilient teeth 19 one from the other, and so as to allow for the release of the engaged receptacle portion 5 and lid portion 4 and so as to allow the lid or cover 4 to hinge (or be moved) away from the receptacle portion 5 to allow for entry thereinto.

In one form of the invention, as shown in the accompanying drawings, the one or more access means 39 can consist of two laterally spaced apart holes **39*a*, separated by a bar 39*b***. This will prevent, or substantially minimize the possibility of, a tool such as a screw driver being inserted to disengage the lid. Thus, in such an arrangement only a tool with bifurcated arms (such as hereinafter described by way of example) can be used to disengage the lid.

In one form of the invention and by way of example only and with reference in particular to FIGS. 1, **4*a*, 4*b*, 4*c* and 6 of the accompanying drawings, a release means can be in the form of a tool 40 having a base 43 which is for example spring-biased with recesses 44 mounted at one end thereof through which removable lugs 45 in the form of lugs preferably having bifurcated arms 46 can pass. By way of example, a container 1 in which the receptacle portion 5 and lid portion 4 are locked together can be inverted (with the cover portion 4 downmost)—as described hereinbefore. The locked container can be placed on the base 43 and a downward motion can be applied to the spring-biased or loaded base 43 which will cause the bifurcated arms 46 or the lugs 45 to move up through the one or more access means 39 (or 39*a*) in the lid 4 and between the inner surface of the front face 2 of the receptacle portion 5 and the protrusions 22, to thus flex out or move the resilient teeth 19 out of engagement with the protrusions 22 and to allow for the release of the lid or cover 4 from the receptacle portion 5. It will be appreciated from the accompanying drawings that the bifurcated arms 46 of the lugs 45 pass up through the one or more access means 39 and 39*a* in the front of the lid or cover portion 4 to pass between the inner surface of the resilient teeth portions 19 and the protrusions 22**, so as to release the one from the other.

It will of course be appreciated that as described hereinbefore, in order for a better understanding of the invention, the invention has been described with reference to the drawings wherein the container is shown as being substantially inverted, with the cover or lid being lowermost and the receptacle portion being uppermost, given that this is the orientation in which, in one form of the invention, the engaged receptacle portion and lid are disengaged one from the other. It should be appreciated however that similar means of engagement can be used with the positioning of the teeth and abutments, and the positioning of the lugs and holes being transposed between different integers.

It should also be appreciated that the release means 40 is described also and illustrated by way of example only. Any appropriate release means with lugs (and in one form of the invention bifurcated lugs), able to disengage the locking arrangement and engagement between the lid and the receptacle portion can be used to advantage.

This invention has been described by way of example only and modifications and improvements may be made to the invention without departing from the scope thereof, as defined by the appended claims.

I claim:

1. A container including a receptacle portion and a lid; and wherein butt ends thereof are hingeably connected one to the other; front faces of said receptacle potion and said lid being so formed as to allow for releasable locking engagement therebetween; at least one resiliently mounted tooth being formed or provided on and within said front face of said receptacle portion; said at least one tooth including a body portion with an aperture extending therethrough; at least one protrusion being provided and extending inwardly from said front face of said lid; wherein on said lid being hinged downwardly over said receptacle potion, said at least one protrusion will contact and move over said at least one resiliently mounted tooth, so as to releasably engage within said aperture of said at least one tooth and so as to releasably lock said receptacle portion and said lid together; at least one access means being provided and extending through a top of said lid, adjacent said front face thereof, said access means comprising a plurality of apertures through said top of said lid, such as to allow for the insertion of release means through said at least one access means and between said at least one tooth and said front face of said lid, such as to bring about disengagement between said at least one tooth and said at least one protrusion, and subsequent release of said lid from said receptacle portion.

2. A container including a receptacle portion and a lid; and wherein butt ends thereof are hingeably connected one to the other; front faces of said receptacle potion and said lid being so formed as to allow for releasable locking engagement therebetween; a plurality of resiliently mounted, laterally spaced apart teeth being formed with and extending upwardly from and inward of said front face of said receptacle portion; said teeth including a body portion with an aperture extending therethrough; a plurality of laterally spaced apart protrusions being provided and extending inwardly from said front face of said lid; wherein on said lid being hinged over said receptacle portion, said protrusions will contact and move over said resiliently mounted teeth, so as to releasably engage within said apertures and so as to releasably lock said receptacle portion and said lid together; a plurality of access means being provided and extending through a top of said lid, adjacent said front face thereof, such as to allow for the substantially simultaneous insertion of a plurality of release means through said plurality of access means and between each resilient tooth and said front face of said lid, such as to bring about simultaneous disengagement between said teeth and said protrusions, and subsequent release of said lid from said receptacle portion.

3. A container as claimed in claim 2, wherein said plurality of access means comprises a plurality of laterally spaced apart holes extending across and through the top of said lid, adjacent said front face thereof, such that when said receptacle portion and lid are engaged one with the other, said holes are positioned substantially above said engaged teeth and protrusions.

4. A container as claimed in claim 2, wherein said plurality of access means comprises a plurality of laterally spaced apart holes extending across and through the top of said lid, adjacent said print face thereof, such that when said receptacle portion and lid are engaged one with the other, said holes are positioned substantially above said engaged teeth and protrusions; wherein each hole is divided into two laterally spaced apart sections such as to allow for location of bifurcated release means.

5. A container as claimed in claim 2, wherein upper sides of said receptacle portion are stepped, and lower ends of sides of said lid portion are so formed as to engage within said step on closure of said lid over said receptacle portion.

6. A container as claimed in claim 2, wherein said front faces of said receptacle portion and lid are formed so as to be generally opaque.

7. A container as claimed in claim 2, wherein butt ends of said receptacle portion and said lid are provided with alternately, laterally spaced apart, housing portions having an elongate wall opening in a wall thereof, and curvilinear cover portions; the arrangement being such that with said adjacent butt ends that juxtapose relative to each other, so as to be hingeably engageable, the spaced apart housing portions of respective butt ends are so located relative to each other that bores extending therethrough are in substantial axial alignment, such as to allow for the insertion and location of elongate retaining means therein and therethrough; said alternately and laterally spaced apart curvilinear cover portions extending at least partially over and about each of said housing portions.

8. A container as claimed in claim 2 formed of a plastic material.

9. A container as claimed in claim 2 in the form of a security container.

10. A container including a receptacle portion and a lid; and wherein butt ends thereof are hingeably connected one to the other; front faces of said receptacle portion and said lid being so formed as to allow for releasable locking engagement therebetween; a plurality of resiliently mounted, laterally spaced apart teeth being formed with and extending upwardly from and inward of said front face of said receptacle portion; said teeth including a body portion with an aperture extending therethrough; a plurality of laterally spaced apart protrusions being provided and extending inwardly from said front face of said lid; wherein on said lid being hinged over said receptacle portion, said protrusions will contact and move over said resiliently mounted teeth, so as to releasably engage within said apertures and so as to releasably lock said receptacle portion and said lid together; a plurality of access means being provided and extending through a top of said lid, adjacent said front face thereof, such as to allow for the insertion of a plurality of release means through said plurality of access means and between each resilient tooth and said front face of said lid, such as to bring about disengagement between said teeth and said protrusions, and subsequent release of said lid from said receptacle portion, wherein abutment portions extend upwardly from the inner surface of the front face of the receptacle portion, between said resiliently mounted teeth, such that said abutment portions and said teeth are laterally and alternately spaced apart across an inner surface of the front face of said receptacle portion.

11. A container as claimed in claim 10, wherein laterally spaced apart raised portions or humps extend across an inner surface of the top of the lid, and engage behind said abutment portions.

* * * * *